US011214924B2

(12) United States Patent
Inagaki et al.

(10) Patent No.: US 11,214,924 B2
(45) Date of Patent: Jan. 4, 2022

(54) VAPORIZATION TYPE HUMIDIFICATION UNIT, CONTROL METHOD OF VAPORIZATION TYPE HUMIDIFICATION UNIT, AND SHEET MANUFACTURING APPARATUS

(71) Applicant: SEIKO EPSON CORPORATION, Tokyo (JP)

(72) Inventors: Yuta Inagaki, Nagano (JP); Hiroyasu Saita, Nagano (JP); Kiyoshi Tsujino, Nagano (JP); Yutaka Saito, Nagano (JP); Masahide Nakamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 139 days.

(21) Appl. No.: 16/461,050

(22) PCT Filed: Nov. 6, 2017

(86) PCT No.: PCT/JP2017/039968
§ 371 (c)(1),
(2) Date: May 15, 2019

(87) PCT Pub. No.: WO2018/092626
PCT Pub. Date: May 24, 2018

(65) Prior Publication Data

US 2019/0309475 A1 Oct. 10, 2019

(30) Foreign Application Priority Data

Nov. 7, 2016 (JP) ..... JP2016-223853

(51) Int. Cl.
*D21G 7/00* (2006.01)
*D21G 9/00* (2006.01)
(Continued)

(52) U.S. Cl.
CPC ..... *D21G 7/00* (2013.01); *D04H 1/732* (2013.01); *D21G 9/0009* (2013.01); *F24F 3/14* (2013.01);
(Continued)

(58) Field of Classification Search
CPC . D21G 7/00; D21G 9/0009; F24F 3/14; F24F 2006/008; F24F 6/02
(Continued)

(56) References Cited

U.S. PATENT DOCUMENTS

2019/0193296 A1* 6/2019 Mikoshiba ..... D21F 9/00

FOREIGN PATENT DOCUMENTS

CN 102965996 A 3/2013
DE 10 2012 213 677 A1 2/2013
(Continued)

*Primary Examiner* — Eric Hug
(74) *Attorney, Agent, or Firm* — Global IP Counselors, LLP

(57) ABSTRACT

The vaporization type humidification unit includes a vaporization unit that evaporates moisture, a first blower that sucks humidification air humidified by the vaporization unit, a transport tube that is connected to the first blower and through which the air discharged from the first blower is transported, a second blower connected to the transport tube and discharging the humidification air discharged from the first blower side toward outside, an opening provided in a middle of the transport tube, a humidity measurement unit installed on a discharging side of the second blower, and a control unit that controls an air flow rate discharged from the first blower and the second blower, in which the control unit controls the air flow rate discharged from the second blower to a desired value and controls the air flow rate discharged from the first blower based on a humidity measured by the humidity measurement unit.

8 Claims, 5 Drawing Sheets

(51) Int. Cl.

| | |
|---|---|
| ***F24F 3/14*** | (2006.01) |
| ***F24F 6/00*** | (2006.01) |
| ***F24F 6/12*** | (2006.01) |
| ***D04H 1/732*** | (2012.01) |
| ***F24F 6/04*** | (2006.01) |

(52) U.S. Cl.
CPC ..... *F24F 6/00* (2013.01); *F24F 6/04* (2013.01); *F24F 6/12* (2013.01)

(58) Field of Classification Search
USPC ..... 162/252, 263, DIG. 6
See application file for complete search history.

(56) References Cited

FOREIGN PATENT DOCUMENTS

| | | | | |
|---|---|---|---|---|
| EP | 2918927 | | * | 9/2015 |
| JP | 05-006446 | U | | 1/1993 |
| JP | 2000-066735 | A | | 3/2000 |
| JP | 2005-024176 | A | | 1/2005 |
| JP | 2006-170543 | A | | 6/2006 |
| JP | 2009-210167 | A | | 9/2009 |

* cited by examiner

VAPORIZATION TYPE HUMIDIFICATION UNIT, CONTROL METHOD OF VAPORIZATION TYPE HUMIDIFICATION UNIT, AND SHEET MANUFACTURING APPARATUS

CROSS-REFERENCE TO RELATED APPLICATIONS

This application is a U.S. National stage application of International Patent Application No. PCT/JP2017/039968, filed on Nov. 6, 2017, which claims priority under 35 U.S.C. § 119(a) to Japanese Patent Application No. 2016-223853, filed in Japan on Nov. 17, 2016. The entire disclosure of Japanese Patent Application No. 2016-223853 is hereby incorporated herein by reference.

TECHNICAL FIELD

The present invention relates to a vaporization type humidification unit, a control method of a vaporization type humidification unit, and a sheet manufacturing apparatus.

BACKGROUND ART

In general, as disclosed in Japanese Unexamined Patent Application Publication No. 2005-24176, as a control method of a vaporization type humidifier, there is known a vaporization type humidifier that controls the number of rotations of a blower so as to supply necessary humidification amount and controls humidification amount by controlling air flow rate based on the difference between humidity set in advance and current humidity measured by a humidity sensor that measures humidity in a room to be humidified.

A problem is that, in the vaporization type humidifier disclosed in Japanese Unexamined Patent Application Publication No. 2005-24176, it is necessary to vary the air flow rate in order to control the humidification amount. Therefore, when the humidifier described above is applied to a dry type waste paper recycling machine that uses air transport or an air raid method, a variation in the air flow rate influences the transport air of material and accumulation distribution of the material in a sheet formation unit that uses an air raid method such that there is a concern that a finished sheet would end up being non-uniform.

SUMMARY

The present invention provides a solution to at least a part of the problem described above and can be realized in the following aspects or application examples.

Application Example 1

According to the present application example, there is provided a vaporization type humidification unit that includes a vaporization unit that evaporates moisture, a first blower that sucks a humidification air humidified by the vaporization unit, a transport tube that is connected to the first blower and through which air discharged from the first blower is transported, a second blower that is connected to the transport tube and through which the humidification air discharged from the first blower side is discharged toward outside, an opening provided in a middle of the transport tube, a humidity measurement unit installed on a discharging side of the second blower, and a control unit that controls air flow rate discharged from the first blower and the second blower, in which the control unit controls air flow rate discharged from the second blower to a desired value and controls the air flow rate discharged from the first blower based on a humidity measured by the humidity measurement unit.

According to the present application example, based on the humidity measured by the humidity measurement unit, the air flow rate of the first blower is controlled. Therefore, when the air flow rate of the first blower is made variable, a difference is generated between the air flow rate of the first blower and the air flow rate of the second blower, but the difference in the air flow rate is adjusted by taking-in and releasing of the outside air through the opening. In this way, the air flow rate discharged from the second blower is kept constant. Also, a variation of the air flow rate of the first blower varies a mixing ratio of the air discharged from the first blower to the outside air flow rate introduced from the opening. In this way, humidification amount is controllable. That is, it is possible to control the humidification amount easily in a state where the air flow rate discharged from the second blower is kept constant. The humidification amount is the amount of moisture given to air.

Application Example 2

According to the present application example, there is provided the vaporization type humidification unit that includes a vaporization unit that evaporates moisture, a first blower that discharges air toward the vaporization unit, a transport tube that is connected to the vaporization unit and through which air that has passed through the vaporization unit is transported, a second blower connected to the transport tube and discharging the air discharged from the vaporization unit toward outside, an opening provided in a middle of the transport tube, a humidity measurement unit installed on the discharging side of the second blower, and a control unit that controls an air flow rate discharged from the first blower and the second blower, in which the control unit controls the air flow rate discharged from the second blower to a desired value and, controls the air flow rate discharged from the first blower based on a humidity measured by the humidity measurement unit.

According to the present application example, based on the humidity measured by the humidity measurement unit, the air flow rate of the first blower is controlled. In this case, when the air flow rate of the first blower is made variable, a difference is generated between the air flow rate of the first blower and the air flow rate of the second blower, but the difference in the air flow rate is adjusted by taking-in and releasing of the outside air through the opening. In this way, the air flow rate discharged from the second blower is kept constant. Also, a variation of the air flow rate of the first blower varies the mixing ratio of the air discharged from the first blower to the outside air flow rate introduced from the opening. In this way, the humidification amount is controllable. That is, it is possible to control the humidification amount easily in a state where the air flow rate discharged from the second blower is kept constant.

Application Example 3

In the vaporization type humidification unit, according to the above application example, it is preferable that the vaporization unit include a humidification filter.

According to the present application example, mounting of the humidification filter enlarges a contact area with the air. Therefore, it is possible to evaporate moisture efficiently.

Application Example 4

In the vaporization type humidification unit according to the above application example, when the measured humidity measured by the humidity measurement unit is high relative to a predetermined humidity, it is preferable that the control unit reduce the air flow rate from the first blower and that the second blower raise an intake flow rate of the outside air from the opening.

According to the present application, when the measured humidity of the humidity measurement unit is high relative to the predetermined humidity, the air flow rate of the first blower is reduced. Then, outside air as much as the air flow rate reduced by the first blower is taken in through the opening, and the air flow rate discharged from the second blower is kept constant. Then, since the mixing ratio of the air taken in from outside air is high in the air discharged from the second blower, the humidification amount is reduced. Therefore, it is possible to lower the humidity to the predetermined humidity easily.

Application Example 5

In the vaporization type humidification unit according to the above application example, when the humidity measured by the humidity measurement unit is low relative to a predetermined humidity, it is preferable that the control unit raise the air flow rate of the first blower and that the second blower reduce an intake flow rate of the outside air from the opening.

According to the present application example, when the measured humidity of the humidity measurement unit is low relative to the predetermined humidity, the air flow rate of the first blower is raised. Then, the intake flow rate of the outside air as much as the air flow rate raised by the first blower is reduced, and the air flow rate discharged from the second blower is kept constant. Then, since the mixing ratio of the air taken in from outside air is low in the air discharged from the second blower, the humidification amount is raised. Therefore, it is possible to raise the humidity to the predetermined humidity easily.

Application Example 6

According to the present application example, there is provided a control method of the vaporization type humidification unit that includes a vaporization unit that evaporates moisture, a first blower that sucks the humidification air humidified by the vaporization unit, a transport tube that is connected to the first blower and through which the air discharged from the first blower is transported, a second blower connected to the transport tube and discharging the humidification air discharged from the first blower side toward outside, an opening provided in a middle of the transport tube, and a humidity measurement unit installed on the discharging side of the second blower, in which the air flow rate discharged from the second blower is controlled to a desired value and an air flow rate discharged from the first blower is controlled based on a humidity measured by the humidity measurement unit.

According to the present application example, based on the humidity measured by the humidity measurement unit, the air flow rate of the first blower is controlled. At this time, when the air flow rate of the first blower is made variable, a difference is generated between the air flow rate of the first blower and the air flow rate of the second blower, but the difference in the air flow rate is adjusted by the taking-in and releasing of the outside air through the opening. In this way, the air flow rate discharged from the second blower is kept constant. Also, a variation of the air flow rate of the first blower varies the mixing ratio of the air discharged from the first blower to the outside air flow rate introduced from the opening. In this way, the humidification amount is controllable. That is, it is possible to control the humidification amount easily in a state where the air flow rate discharged from the second blower is kept constant.

Application Example 7

According to the present application example, there is provided a vaporization type humidification unit that includes a vaporization unit that evaporates moisture, a first blower disposed on an upstream or a downstream of the vaporization unit in a direction of air flow and feeding humidification air humidified by the vaporization unit, a second blower disposed on the downstream of the first blower and mixture air of the humidification air fed from the first blower with the outside air to discharge, a humidity measurement unit installed on a discharging side of the second blower, and a control unit that controls a humidification amount by varying an air flow rate fed by the first blower based on a measurement result of the humidity measurement unit without varying the air flow rate discharged from the second blower.

Application Example 8

Also, according to the present application example there is provided a control method of a vaporization type humidification unit that includes a vaporization unit that evaporates moisture, a first blower disposed on the upstream or the downstream of the vaporization unit in the direction of the air flow and feeding the humidification air humidified by the vaporization unit, and a second blower disposed on the downstream of the first blower and mixing the humidification air discharged from the first blower with the outside air to discharge, and controls a humidification amount by varying an air flow rate fed from the first blower without varying an air flow rate discharged from the second blower.

According to Application Examples 7 and 8, raising the air flow rate fed from the first blower lowers the amount of the outside air to be mixed, and it is possible to raise the humidification amount. Also, lowering the air flow rate fed from the first blower raise the amount of the outside air to be mixed, and it is possible to lower the humidification amount. In this way, it is possible to control the humidification amount in a state where the air flow rate discharged from the second blower is kept constant. When the air flow rate fed from the first blower is larger than the air flow rate discharged from the second blower, the humidification air from the first blower is directly discharged from the second blower without being mixed with the outside air.

Application Example 9

According to the present application example, there is provided a sheet manufacturing apparatus that includes a vaporization type humidification unit described in the above application examples.

According to the present application example, by the mounting of the vaporization type humidification unit, an appropriate humidification amount is provided in a state where the air flow rate to a raw material including fibers, sheet accumulation unit, or the like is kept constant. Therefore, it is possible to avoid stagnation of the raw material including fibers under the influence of electrification and adhesion of the raw materials to each other, to adjust the moisture amount of the raw material, and to suppress the non-uniformity in the density of finished sheet without inflicting an adverse effect on the transported air or the sheet accumulation unit.

Application Example 10

According to the above application example, the portion of the sheet manufacturing apparatus through which the raw material of the sheet or the material passes is humidified by the vaporization type humidification unit.

According to the present application example, a portion through which raw materials or coarsely crushed pieces obtained by crushing a raw material pass or a portion through which defibrillated material obtained by defibrillating the raw material passes is humidified by the vaporization type humidification unit such that it is possible to suppress trouble caused by electrification.

DESCRIPTION OF EMBODIMENTS

In the following, embodiments of the present invention will be described with reference to the drawings. It should be noted that the scale of each layer and each member is made different from the actual scale so as to make each layer and each member recognizable in each of the following diagrams.

<Sheet Manufacturing Apparatus>

Figure 1:
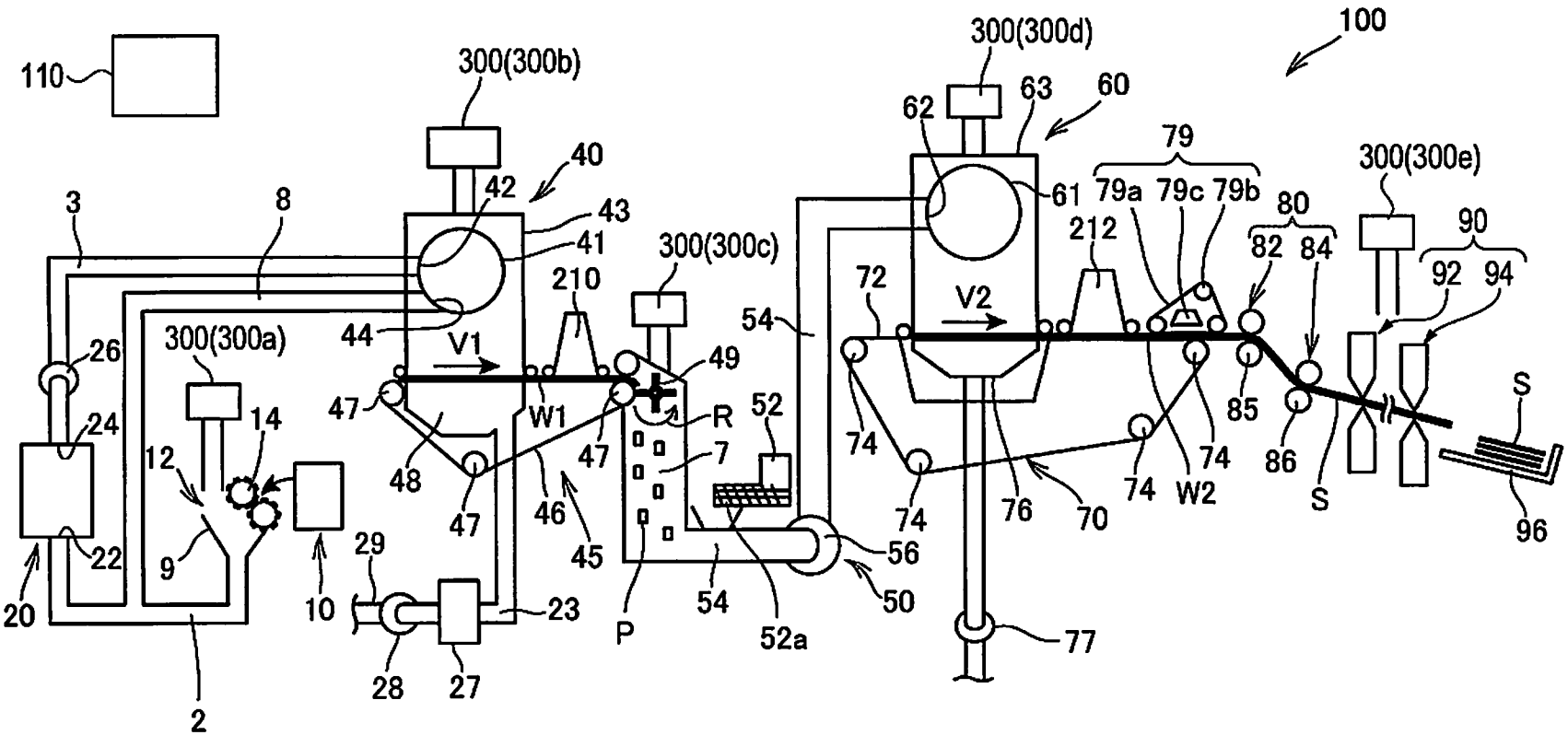
FIG. 1 is an outlining diagram showing a configuration of sheet manufacturing apparatus according to an embodiment.

FIG. 1 is an outlining diagram showing a configuration of a sheet manufacturing apparatus according to an embodiment.

First, a sheet manufacturing apparatus 100 according to the embodiment is an apparatus suitable for manufacturing a new paper by pressing, heating, and cutting after used waste paper such as confidential paper as a raw material is defibrillated and fibrillated, for example.

A variety of additives may be mixed into the fibrillated raw material (material) to improve binding strength and whiteness of the paper product and add color, scent, and a function such as fire resistance or the like in accordance with use. Also, by controlling the density, thickness, and shape of the paper to mold, it is possible to manufacture paper of various thickness and sizes in accordance with use such as A3 or A4 office paper, business card paper, and the like.

The sheet manufacturing apparatus 100 includes a supply unit 10, a coarsely crushing unit 12, a defibrillation unit 20, a sorting unit 40, a first web formation unit 45, a rotating object 49, a mixing unit 50, an accumulation unit 60, a second web formation unit 70, a transport unit 79, a sheet formation unit 80, a cutting unit 90, and a control unit 110.

Also, the sheet manufacturing apparatus 100 includes humidification units 210 and 212 and vaporization type humidification unit 300 (300*a*, 300*b*, 300*c*, 300*d*, and 300*e* in this embodiment) for the purpose of humidifying the raw material and/or humidifying the space through which the raw material moves. Here, the raw material before fibrillation and the fibrillated raw material (material) are included in the raw material.

Also, the humidification units 210 and 212 indicate places where the air humidified by a mist type humidification unit is supplied. The mist type humidification unit includes a water tray (not shown) that functions as a water tank that stores water and a vibration unit (not shown) that atomizes the water in the water tray and supplies the mist generated by the vibration unit.

The supply unit 10 supplies raw materials to the coarsely crushing unit 12. The raw material of which the sheet manufacturing apparatus 100 manufactures sheets may be any material that includes fibers such as paper, pulp, pulp sheet, cloth including nonwoven fabric, fabric, or the like, for example. In the present embodiment, a configuration in which the sheet manufacturing apparatus 100 uses waste paper as a raw material is presented as an example. The supply unit 10 may be configured to include an automatic input device that feeds the waste paper to the coarsely crushing unit 12 from the stacker.

The coarsely crushing unit 12 cuts (coarsely crushes) the raw material supplied by the supply unit 10 by a coarsely crushing blade 14 into coarsely crushed pieces. The coarsely crushing blade 14 cuts the raw material in the atmosphere (in the air). The coarsely crushing unit 12 includes, for example, a pair of coarsely crushing blade 14 that cuts the raw material while pinching the raw material and a driving unit (not shown) that rotates the coarsely crushing blade 14 and may be configured similarly to a so-called shredder. A coarsely crushed piece may be of any shape and size, as long as it is suitable for defibrillation processing by the defibrillation unit 20. For example, the coarsely crushing unit 12 cuts the raw material into paper shreds having a size of one to several centimeters or less on each of the four sides.

The coarsely crushing unit 12 includes a chute (also referred to as hopper) 9 that receives coarsely crushed pieces cut by the coarsely crushing blade 14 and falling. The chute 9 has, for example, a tapering shape with the width gradually narrowing in a direction (advancing direction) in which the coarsely crushed pieces flow. Therefore, the chute 9 can receive many coarsely crushed pieces.

A tube 2 communicating with the defibrillation unit 20 is connected to the chute 9, and the tube 2 forms a transport path for transporting the raw material (coarsely crushed pieces) cut by the coarsely crushing blade 14 to the defibrillation unit 20. The coarsely crushed pieces are collected by the chute 9 and fed (transported) to the defibrillation unit 20 through the tube 2.

Humidification air is supplied to the chute 9, or to the vicinity of the chute 9 included in the coarsely crushing unit 12 by the vaporization type humidification unit 300*a*. In this way, it is possible to suppress the phenomenon that the coarsely crushed material obtained by cutting by the coarsely crushing blade 14 is adsorbed to the inner surface of the chute 9 or the tube 2 by the static electricity. Also, since the coarsely crushed material obtained by the cutting by the coarsely crushing blade 14 is fed to the defibrillation unit 20 together with the (highly humid) humidification air, the effect of suppressing adsorption of defibrillated material in the defibrillation unit 20 can also be anticipated.

Also, vaporization type humidification unit 300*a* may be configured to supply the humidification air to the coarsely crushing blade 14 and remove static electricity from the raw material supplied by the supply unit 10. Also, together with the vaporization type humidification unit 300*a*, an ionizer may be used to remove static electricity.

Defibrillation unit 20 defibrillates coarsely crushed material obtained by the cutting by the coarsely crushing unit 12. Specifically, the defibrillation unit 20 defibrillates the raw material (coarsely crushed pieces) obtained by cutting by the coarsely crushing unit 12 to generate defibrillated material. Here, "to defibrillate" means to unravel raw material (material to be defibrillated), formed by the binding of a plurality of fibers into single fibers. The defibrillation unit 20 also has a function of separating substances such as resin particles adsorbed to the raw material, ink, toner, bleeding prevention agent, and the like from the fiber.

What has passed through the defibrillation unit 20 is referred to as "defibrillated material". In the defibrillated material, in addition to the unraveled defibrillated fibers, resin (resin for binding a plurality of fibers) particles separated from fibers at the time of defibrillation, coloring agents such as ink, toner, or the like, and additives such as bleeding prevention agent, paper strengthening agent, or the like are included in some cases.

The shape of unraveled defibrillated material is a string shape or a ribbon shape. The unraveled defibrillated material may exist in a state (independent state) of not being entangled with another unraveled fiber or may exist in a lumpy state (state of forming a so-called "lump") of being entangled with another unraveled defibrillated material.

Defibrillation unit 20 performs defibrillation in a dry manner. Here, performing treatment such as defibrillation or the like in the atmosphere (in the air) is referred to as a dry type. In the present embodiment, the defibrillation unit 20 is configured to use an impeller mill. Specifically, the defibrillation unit 20 includes a rotor (not shown) rotating at a high speed and liner (not shown) positioned on the outer periphery of the rotor. The coarsely crushed pieces obtained by the cutting by coarsely crushing unit 12 are defibrillated pinched between the rotor and the liner of the defibrillation unit 20. The defibrillation unit 20 generates an air flow by the rotation of the rotor. By this air flow, the defibrillation unit 20 can suck the coarsely crushed pieces as a raw material through the tube 2 and transport the defibrillated material to a discharge port 24. The defibrillated material is sent out from the discharge port 24 to a tube 3 and fed to a sorting unit 40 through the tube 3.

In this way, the defibrillated material generated by the defibrillation unit 20 is transported from the defibrillation unit 20 to the sorting unit 40 by the air flow generated by the defibrillation unit 20. Further, the sheet manufacturing apparatus 100 includes a defibrillation unit blower 26 which is an air flow generation device, and the defibrillated material is transported to the sorting unit 40 by the air flow generated by the defibrillation unit blower 26. The defibrillation unit blower 26 is attached to the tube 3 and sucks the air together with the defibrillated material from the defibrillation unit 20 to blow to the sorting unit 40.

The sorting unit 40 includes an inlet port 42 through which the defibrillated material defibrillated by the defibrillation unit 20 flows from the tube 3 together with the air flow. The sorting unit 40 sorts out the defibrillated material to be introduced to the inlet port 42 by the length of the fiber. Specifically, the sorting unit 40 selects, out of the defibrillated material defibrillated by the defibrillation unit 20, the defibrillated material having a size equal to or less than a predetermined size as a first sorted material and the defibrillated material bigger than the first sorted material as a second sorted material. The first sorted material includes fibers, particles, or the like, and the second sorted material includes, for example, big fibers, undefibrillated pieces (coarsely crushed pieces not sufficiently defibrillated into), "lump" into which the defibrillated fibers are lumped together or entangled into, or the like.

The sorting unit 40 includes a drum unit (sieve unit) 41 and a housing unit 43 that houses the drum unit 41. The drum unit 41 is a cylindrical sieve rotationally driven by a motor. The drum unit 41 has a mesh (filter, screen) and functions as a sieve. By the eyes of the mesh, the drum unit 41 sorts out the first sorted material smaller than the size of the eye opening (opening) of the mesh and the second sorted material bigger than the eye opening of the mesh. As a mesh of the drum unit 41, for example, a wire mesh, an expanded metal into which a cut metal plate is stretched, a punching metal which is a metal plate having a hole formed by a press machine or the like is used.

The defibrillated material introduced to the inlet port 42 is fed to the inside of the drum unit 41 together with the air flow, and the first sorted material falls downward from the mesh of the drum unit 41 by the rotation of the drum unit 41. The second sorted material that fails to pass the mesh of the drum unit 41 flows by the air flow flowing from the inlet port 42 into the drum unit 41 and is introduced to the discharge port 44 to be sent out to a tube 8.

The tube 8 connects the inside of the drum unit 41 with the tube 2. The second sorted material flowing through the tube 8 flows through the tube 2 together with the coarsely crushed pieces obtained by the cutting by the coarsely crushing unit 12 and introduced to the inlet port 22 of the defibrillation unit 20. In this way, the second sorted material is returned to the defibrillation unit 20 and is defibrillated.

Also, the first sorted material sorted by the drum unit 41 is dispersed into the air through the eyes of the mesh of the drum unit 41 and falls toward a mesh belt 46 of a first web formation unit 45 positioned below the drum unit 41.

The first web formation unit 45 includes the mesh belt 46 on which the defibrillated material is accumulated and functions as a separation unit that separates from the defibrillated material the removal target material not used for sheet S and to be disposed of. The first web formation unit 45 further includes a stretching roller 47 and a suction unit (suction mechanism) 48.

The mesh belt 46 is a continuous track-shaped belt, is suspended by three stretching rollers 47, and, by the movement of the stretching roller 47, is transported in the direction indicated by an arrow in the figure. The surface of the mesh belt 46 is configured with a mesh in which openings of a predetermined size are arranged in a row.

Out of the first sorted material falling from the sorting unit 40, the fine particles of a size that passes through the mesh eyes fall below the mesh belt 46 and the fibers of a size that cannot pass through the mesh eyes are accumulated on the mesh belt 46 and transported in the arrow direction together with the mesh belt 46. The fine particles falling from the mesh belt 46 include relatively small ones or ones of low density (resin particles, coloring agents, additives, or the like) among the defibrillated material, and are removal target materials that are not used in the manufacturing of the sheet S by the sheet manufacturing apparatus 100.

The mesh belt 46 moves at a constant speed V1 during the normal operation in manufacturing the sheet S. Here, the "during normal operation" refers to "during the operation" excluding "during the execution" of the start control and the stop control of the sheet manufacturing apparatus 100 to be described below, and more specifically refers to "while the sheet manufacturing apparatus 100 is manufacturing the sheet S of the desired quality".

Therefore, the defibrillated material defibrillated by the defibrillation unit 20 is sorted into the first sorted material and the second sorted material by the sorting unit 40, and the second sorted material is returned to the defibrillation unit 20. Also, from the first sorted material, the removal target material is removed by the first web formation unit 45. The remainder of the first sorted material from which the removal target material is removed is a material suitable for manufacturing the sheet S, and the material is accumulated on the mesh belt 46 and forms a first web W1.

The suction unit 48 sucks the air from below the mesh belt 46. The suction unit 48 is connected to the dust collecting unit 27 through a tube 23. The dust collecting unit 27 separates the fine particles from the air flow. A collection blower 28 is disposed below the dust collecting unit 27, the collection blower 28 functions as a dust collecting suction unit that sucks the air from the dust collecting unit 27. Also, the air discharged by the collection blower 28 passes through a tube 29 to be discharged to the outside of sheet manufacturing apparatus 100.

In this configuration, air is sucked from the suction unit 48 through the dust collecting unit 27 by the collection blower 28. In the suction unit 48, the fine particles passing through the mesh eyes of the mesh belt 46 are sucked with the air and fed to the dust collecting unit 27 through the tube 23. The dust collecting unit 27 separates from the air flow and accumulates the fine particles that have passed through the mesh belt 46.

Therefore, on the mesh belt 46, the fibers of the first sorted material from which the removal target material is removed are accumulated and the first web W1 is formed. As the collection blower 28 performs suction, the formation of the first web W1 on the mesh belt 46 is promoted and the removal target material is quickly removed.

Humidification air is supplied to the space that includes the drum unit 41 by the vaporization type humidification unit 300*b*. By the humidification air, it is possible to humidify the first sorted material in the sorting unit 40 and to weaken the adsorption of the first sorted material to the mesh belt 46 due to the electrostatic force. Therefore, it is possible to easily peel off the first sorted material from the mesh belt 46 and also to suppress adsorption of the first sorted material to the inner walls of the rotating object 49 and the housing unit 43 due to the electrostatic force. Also, it is possible to suck the removal target material by the suction unit 48 efficiently.

It should be noted that, in the sheet manufacturing apparatus 100, the configuration of sorting and separating the first sorted material and the second sorted material is not limited to the sorting unit 40 that includes the drum unit 41. For example, a configuration may be adopted in which the defibrillated material defibrillated by the defibrillation unit 20 is classified by a classifier. As a classifier, a cyclone classifier, an elbow jet classifier, or Eddie classifier can be used. By using these classifiers, it is possible to sort and separate the first sorted material and the second sorted material.

Further, with the above classifier, it is possible to realize a configuration of separating and removing the removal target material that includes, among the defibrillated materials, relatively small ones or ones of low density (resin particles, coloring agents, additives, or the like). For example, the fine particles included in the first sorted material may be removed from the first sorted material by a classifier. In this case, a configuration of returning the second sorted material to the defibrillation unit 20, collecting the removal target material by the dust collecting unit 27, and feeding the first sorted material from which the removal target material is removed to the tube 54 is possible.

In the transport path of the mesh belt 46, the air including mist is supplied to the downstream of the sorting unit 40 by the humidification unit 210. The mist which is fine particles of water generated by the humidification unit 210 falls toward the first web W1 and supplies moisture to the first web W1. In this way, it is possible to adjust the moisture amount included in the first web W1 and to suppress the adsorption of the fibers to the mesh belt 46 due to the electrostatic force.

The sheet manufacturing apparatus 100 includes the rotating object 49 that functions as a division unit that divides the first web W1 accumulated on the mesh belt 46. The first web W1 is peeled off from the mesh belt 46 at a position where the mesh belt 46 is folded back by the stretching roller 47 and divided by the rotating object 49.

The first web W1 is a soft material in which fibers are accumulated to form a web shape, and the rotating object 49 unravels and processes the fibers of the first web W1 into a state in which resin can be easily mixed by the mixing unit 50 to be described below.

The rotating object 49 can be of any configuration, but in the present embodiment, the rotating object 49 can be of a rotation feather shape that has plate-shaped blades and rotates. The rotating object 49 is disposed at a position where the first web W1 peeled off from the mesh belt 46 comes into contact with the blades. By the rotation (rotation in the direction indicated by the arrow R in the drawing) of the rotating object 49, the blades collide with and divide the first web W1 peeled off and transported from the mesh belt 46 and generate fragments P.

It is preferable that the rotating object 49 be installed at a position where the blades of the rotating object 49 do not collide with the mesh belt 46. For example, the interval between the tip end of the blade of the rotating object 49 and the mesh belt 46 can be equal to or longer than 0.05 mm and equal to or shorter than 0.5 mm, and in this case, it is possible to divide the first web W1 without inflicting damage to the mesh belt 46 by the rotating object 49.

Fragment P divided by the rotating object 49 falls in the tube 7 and is fed (transported) to the mixing unit 50 by the air flow flowing in the tube 7.

Also, humidification air is supplied to the space including the rotating object 49 by the vaporization type humidification unit 300*c*. In this way, it is possible to suppress the phenomenon that fibers are adsorbed to the inside of tube 7 and the blade of the rotating object 49 due to the static electricity. Also, since highly humid air is supplied to the mixing unit 50 through the tube 7, it is possible to suppress the effect of the static electricity in the mixing unit 50.

The mixing unit 50 includes an additive supply unit 52 (resin supply unit) that supplies additives including a resin, a tube 54 that communicates with the tube 7 and through which the air flow including the fragments P flows, and a mixing blower 56. The fragments P are fibers obtained by the removal of the removal target material from the first sorted material that has passed through the sorting unit 40 as described above.

The mixing unit 50 mixes additives including a resin into the fibers that constitute the fragments P.

Air flow is generated by the mixing blower 56 in the mixing unit 50, and the fragments P and additives are mixed while being transported in the tube 54. Also, the fragments P are loosened in the course of flowing through the tubes 7 and 54 and turn into finer fibrous shapes.

The additive supply unit 52 (resin accommodation unit) is connected to a resin cartridge (not shown) that accumulates additives and supplies additives in the resin cartridge to the tube 54. The additive supply unit 52 temporarily stores additives made of fine powder or fine particles in the resin cartridge. The additive supply unit 52 includes a discharge unit 52*a* (resin supply unit) that feeds the temporarily stored additive to the tube 54.

The discharge unit 52*a* includes a feeder (not shown) that feeds the additive temporarily stored in the additive supply unit 52 to the tube 54 and a shutter (not shown) that opens and closes the tube line that connects the feeder with the tube 54. When the shutter is closed, the tube line or the opening that connects the discharge unit 52*a* with the tube 54 is shut and the supply of additives from the additive supply unit 52 to the tube 54 is cut off.

In a state where the feeder of the discharge unit 52*a* is not in operation, no additive is supplied from the discharge unit 52*a* to the tube 54, but when a negative pressure is generated in the tube 54, there is a possibility that the additives flow to the tube 54 even if the feeder of the discharge unit 52*a* has stopped. By closing the discharge unit 52*a*, it is possible to reliably cut off such flow of the additives.

The additive supplied by the additive supply unit 52 includes a resin for binding a plurality of fibers. It is a thermoplastic resin or a thermosetting resin, and the example thereof includes AS resin, ABS resin, polypropylene, polyethylene, polyvinyl, polystyrene, acrylic resin, polyester resin, polyethylene terephthalate, polyphenylene ether, polybutylene terephthalate, nylon, polyamide, polycarbonate, polyacetal, polyphenylene sulfide, polyether ether ketone, and the like.

These resins may be used alone or in a suitable mixture. That is, the additive may include a single substance, may be a mixture, or may include various types of particles each of which is composed of a single substance or a plurality of substances. Also, the additive may be in a fibrous form or in a powder form.

The resin included in the additive melts by heating and binds a plurality of fibers together. Therefore, in a state where a resin is mixed with fibers, the fibers are not bound to each other in a state where the resin is not heated up to the temperature at which the resin melts.

Also, the additive supplied by the additive supply unit 52 may include a coloring agent for coloring the fibers, a lumping suppressant that suppresses lumping of fibers or lumping of resins, and a fire retardant that makes fibers or the like less susceptible to burning in addition to the resin that binds the fibers in accordance with the type of sheets to be manufactured. Also, the additive that does not include a coloring agent may be colorless or of color thin enough to be considered colorless or may be white.

By the air flow generated by the mixing blower 56, the fragments P that fall down the tube 7 and the additive supplied by the additive supply unit 52 are sucked in the tube 54 and pass through the inside of the mixing blower 56. By the action of the air flow generated by the mixing blower 56 and/or the rotation unit such as the blades of the mixing blower 56, the fibers that constitute the fragments P and the additives are mixed, and this mixture (mixture of the first sorted material and the additive) is transferred to the accumulation unit 60 through the tube 54.

A mechanism for mixing the first sorted material and the additive is not particularly limited, and may be one that agitates by a blade rotating at a high speed, or may be one that utilizes the rotation of a container like a V-type mixer, or may be installed before or after the mixing blower 56.

The accumulation unit 60 accumulates the defibrillated material defibrillated by the defibrillation unit 20. Specifically, the accumulation unit 60 introduces the mixture passing through the mixing unit 50 from the inlet port 62, unravels the lumped defibrillated material (fiber), and drops while dispersing in the air. Further, when the resin of the additive supplied from the additive supply unit 52 is fibrous, the accumulation unit 60 unravels the lumped resin. In this way, the accumulation unit 60 can accumulate the mixture in the second web formation unit 70 uniformly.

The accumulation unit 60 includes a drum unit 61 and a housing unit 63 that houses the drum unit 61. The drum unit 61 is a cylindrical sieve rotationally driven by a motor. The drum unit 61 includes a mesh (filter, screen) and functions as a sieve. By the eyes of the mesh, the drum unit 61 passes the fiber and particles smaller than the mesh eye opening (opening) of the mesh and drops from the drum unit 61. The configuration of the drum unit 61 is, for example, the same as that of the drum unit 41.

The "sieve" of the drum unit 61 may not have a function of sorting out a specific object. That is, the "sieve" used as the drum unit 61 means the one provided with a mesh, and the drum unit 61 may drop all of the mixture introduced into the drum unit 61.

The second web formation unit 70 is disposed below the drum unit 61. The second web formation unit 70 accumulates the passing material that has passed through the accumulation unit 60 and forms the second web W2. The second web formation unit 70 includes, for example, a mesh belt 72, a roller 74, and a suction mechanism 76.

The mesh belt 72 is a continuous track-shaped belt, is suspended by a plurality of rollers 74, and, by the movement of the roller 74, is transported in the direction indicated by an arrow in the figure. The mesh belt 72 is, for example, a metal, a resin, a cloth, a nonwoven fabric, or the like. The surface of the mesh belt 72 is configured with a mesh in which openings of a predetermined size are arranged in a row.

Out of the fibers and particles dropping from the drum unit 61, the fine particles of a size passing through the eyes of the mesh drop below the mesh belt 72, and the fibers of a size that cannot pass through the eyes of the mesh are accumulated on the mesh belt 72 and transported in the arrow direction together with the mesh belt 72. The mesh belt 72 moves at a constant speed V2 during the operation of manufacturing the sheet S.

The eyes of the mesh of the mesh belt 72 are fine and can be of a size that does not allow most of the fibers and particles dropping from the drum unit 61 to pass through. The suction mechanism 76 is provided below the mesh belt 72 (on the opposite to the accumulation unit 60 side). The suction mechanism 76 includes a suction blower 77 and can generate air flow directed toward below the suction mechanism 76, that is, toward the mesh belt 72 from the accumulation unit 60, by the suction force of the suction blower 77.

By the suction mechanism 76, the mixture dispersed in the air by the accumulation unit 60 is sucked onto the mesh belt 72. In this way, the formation of the second web W2 on the mesh belt 72 can be promoted and the discharge speed from the accumulation unit 60 can be increased. Further, by the suction mechanism 76, a down flow can be formed in the falling path of the mixture, and it is possible to prevent lumping of the defibrillated material and additives during the falling.

The suction blower 77 (accumulation suction unit) may discharge the air sucked from the suction mechanism 76 to the outside of the sheet manufacturing apparatus 100 through a collection filter (not shown). Or, the air sucked by the suction blower 77 may be fed to the dust collecting unit 27 and the removal target material included in the air sucked by the suction mechanism 76 can be collected.

Humidification air humidified by the vaporization type humidification unit 300*d* is supplied to the space that includes the drum unit 61. By this humidification air, the inside of the accumulation unit 60 can be humidified, the adsorption of fibers and particles to the housing unit 63 due to the electrostatic force can be suppressed, the fibers and particles can be dropped to the mesh belt 72 fast, and the second web W2 in a preferable shape can be formed.

As described above, through the accumulation unit 60 and the second web formation unit 70 (web formation step), the second web W2 that includes a large amount of air to be in a soft and bulging state is formed. The second web W2 accumulated on the mesh belt 72 is transported to the sheet formation unit 80.

In the transport path of the mesh belt 72, the air including mist is supplied by the humidification unit 212 on the downstream of the accumulation unit 60. In this way, the mist generated by the humidification unit 212 is supplied to the second web W2 and the moisture amount included in the second web W2 is adjusted. In this way, it is possible to suppress the adsorption of the fibers to the mesh belt 72 by the static electricity.

The sheet manufacturing apparatus 100 is provided with the transport unit 79 that transports the second web W2 on the mesh belt 72 to the sheet formation unit 80. The transport unit 79 includes, for example, a mesh belt 79*a*, a roller 79*b*, and a suction mechanism 79*c*.

The suction mechanism 79*c* generates an air flow to suck the second web W2 and cause the second web W2 to be adsorbed on to the mesh belt 79*a*. The mesh belt 79*a* is moved by the rotation of the roller 79*b* and transports the second web W2 to the sheet formation unit 80. The moving speed of the mesh belt 72 and the moving speed of the mesh belt 79*a* are the same, for example. In this way, the transport unit 79 peels off from the mesh belt 72, and transports to the mesh belt 72, the second web W2.

The sheet formation unit 80 forms the sheet S from the accumulation accumulated in the accumulation unit 60. Specifically, the sheet formation unit 80 presses and heats the second web W2 (accumulation) accumulated on the mesh belt 72 and transported by the transport unit 79 to mold the sheet S. In the sheet formation unit 80, the fibers and additives of the defibrillated material included in the second web W2 are heated, so that a plurality of fibers in the mixture are bound to each other through the additive (resin).

The sheet formation unit 80 includes a pressing unit 82 that presses the second web W2 and a heating unit 84 that heats the second web W2 pressed by the pressing unit 82. The pressing unit 82 is configured with a pair of calendar rollers 85 and presses the second web W2 by pinching it with predetermined nip pressure. The thickness of the second web W2 is reduced and the density of the second web W2 is increased by the pressing.

One of the pair of calendar rollers 85 is a driving roller driven by a motor (not shown) and the other is a driven roller. The calendar roller 85 rotates by a driving force of a motor (not shown) and transports the second web W2 highly densified by the pressing toward the heating unit 84.

The heating unit 84 can be configured with a heating roller (heater roller), a heat press molding machine, a hot plate, a warm air blower, an infrared heater, and a flash fixing device. The heating unit 84 includes a pair of heating rollers 86. The heating roller 86 is heated to the predetermined temperature by a heater installed inside or outside. The heating roller 86 pinches and heats the second web W2 pressed by the calendar roller 85 and forms the sheet S.

Also, one of the pair of heating rollers 86 is a driving roller driven by a motor (not shown), and the other is a driven roller. The heating roller 86 rotates by the driving force of a motor (not shown) and transports the heated sheet S toward the cutting unit 90.

It should be noted that the number of calendar rollers 85 included in the pressing unit 82 and the number of the heating roller 86 included in the heating unit 84 are not particularly limited.

The cutting unit 90 cuts the sheet S molded by the sheet formation unit 80. The cutting unit 90 includes a first cutting unit 92 that cuts the sheet S in a direction intersecting with the transport direction of sheet S and a second cutting unit 94 that cuts the sheet S in a direction parallel to the transport direction. The second cutting unit 94 cuts the sheet S that has passed through the first cutting unit 92, for example.

Humidification air is supplied to the space including the cutting unit 90 by the vaporization type humidification unit 300*e*. By the humidification air, it is possible to humidify the sheet S and it is possible to adjust the moisture amount of the sheet S.

Thus, the sheet S of a single slip of a predetermined size is molded. The cut sheet S of a single slip is discharged to the discharge unit 96. The discharge unit 96 includes a discharge tray that discharges the sheet S of a predetermined size or a stacker that accumulates the sheet S.

<Vaporization Type Humidification Unit>

Figure 2:
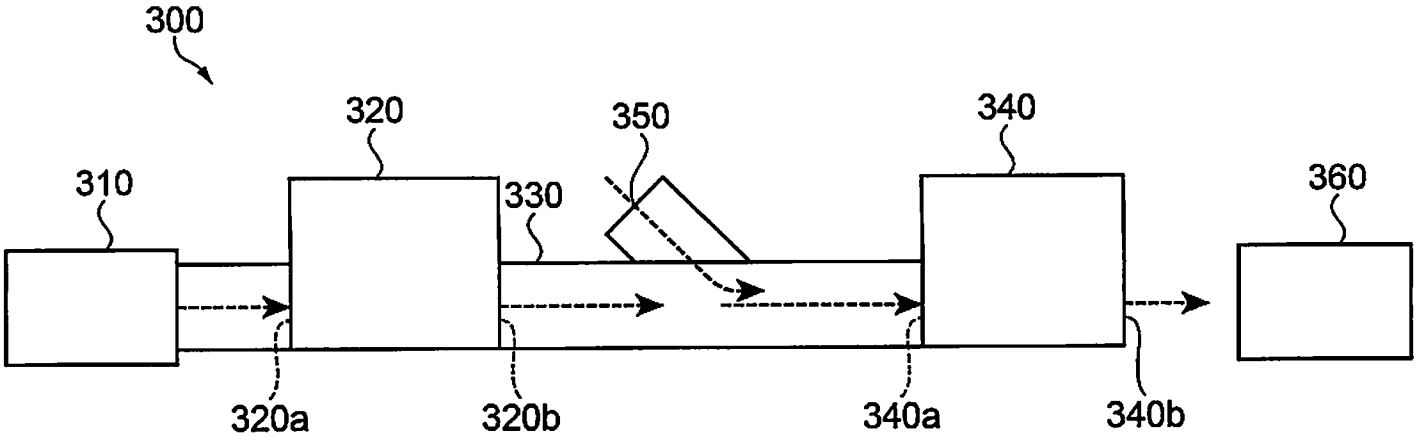
FIG. 2 is a schematic diagram showing a configuration of a vaporization type humidification unit.

Next, the configuration of the vaporization type humidification unit 300 will be described. FIG. 2 is a schematic diagram showing the configuration of the vaporization type humidification unit 300. The vaporization type humidification unit 300 includes the vaporization unit 310 that evaporates moisture, the first blower 320 that sucks the humidification air humidified by the vaporization unit 310, the transport tube 330 that is connected to the first blower 320 and through which the air discharged from the first blower 320 is transported, the second blower 340 that is connected to the transport tube 330 and through which the humidification air discharged from the first blower 320 side is discharged toward outside, the opening 350 provided in a middle of the transport tube 330, the humidity measurement unit 360 installed on a discharging side of the second blower 340, and the control unit 110 that controls air flow rate discharged from the first blower 320 and the second blower 340. The control unit 110 of the sheet manufacturing apparatus 100 is also used as the control unit 110 of the present embodiment.

The vaporization unit 310 includes a humidification filter (not shown), a water storage unit (not shown) that stores water for storing water to immerse the humidification filter, and the like and generates air in which the steam amount increases as the air passes through the humidification filter. That is, a vaporization type humidification method applies to the vaporization unit 310.

The first blower 320 includes an air intake port 320*a* that sucks air which has passed through the vaporization unit 310 and an air outlet port 320*b* that discharges air to the downstream. The first blower 320 includes an impeller and a motor that rotationally drives the impeller, and the number of rotations of the motor is controlled based on a command from the control unit 110. In this way, the air flow rate discharged from the first blower 320 is controlled.

One end of the transport tube 330 is connected to the air outlet port 320*b* of the first blower 320, and the other end of the transport tube 330 is connected to the air intake port 340*a* of the second blower 340. The discharge from the first blower 320 is transported to the second blower 340 side through the transport tube 330.

The second blower 340 is connected to the transport tube 330 and includes an air intake port 340*a* that sucks the discharge from the first blower 320 side and an air outlet port 340*b* that discharges to the outside. The second blower 340 includes an impeller and a motor that rotationally drives the impeller, and the number of rotations of the motor is controlled based on the command from the control unit 110. In this way, the air flow rate discharged from the second blower 340 is controlled.

The opening 350 is provided in a middle of the transport tube 330 between the first blower 320 and the second blower 340. The opening 350 communicates with the transport tube 330. Thus, the transport tube 330 and the outside air communicate with each other. The shape of the opening 350 is not limited, and simply a hole may be provided in the transport tube 330, or the transport tube 330 may be branched into a Y shape or a T shape. Also, the opening 350 may extend in a tubular shape.

The humidity measurement unit 360 is installed on the discharging side of the second blower 340 and measures humidity of the discharge destination of the second blower 340. For example, the humidity measurement unit 360 is installed in the vicinity of an object member that receives the discharge of the second blower 340.

<Control Unit>

Figure 3:
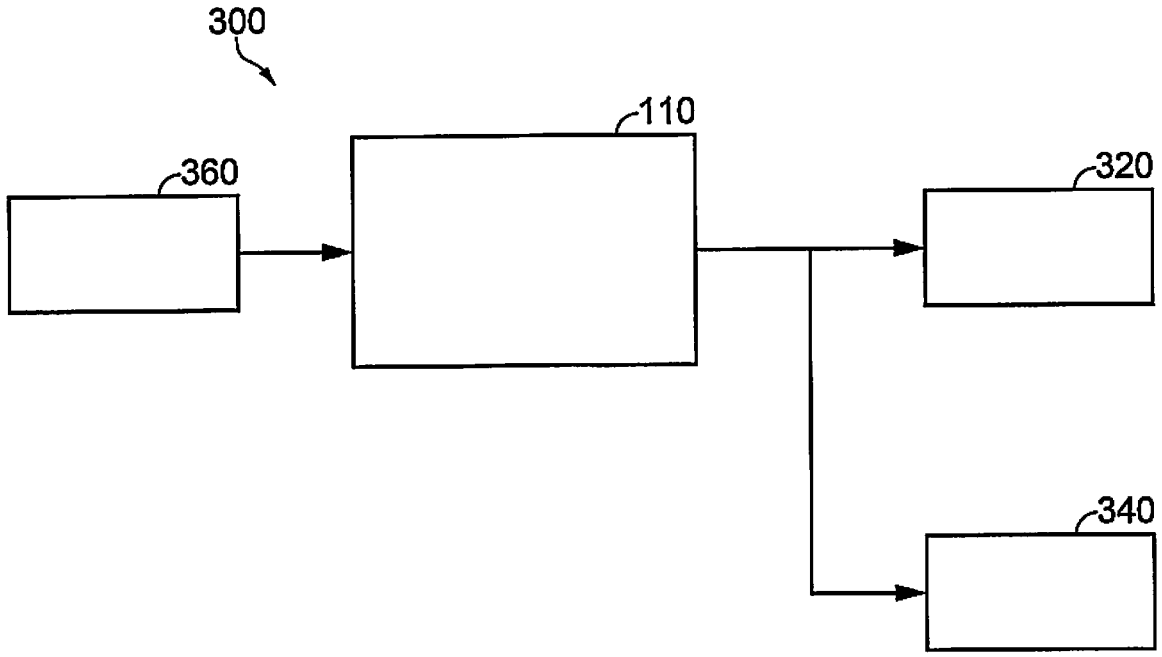
FIG. 3 is a block diagram showing a configuration of a control unit of the vaporization type humidification unit.

Next, the configuration of the control unit of the vaporization type humidification unit 300 will be described. FIG. 3 is a block diagram showing the configuration of the control unit of the vaporization type humidification unit. The control unit 110 is connected to the humidity measurement unit 360, the first blower 320, and the second blower 340.

The control unit 110 is connected to the supply unit 10, the coarsely crushing unit 12, the defibrillation unit 20, the first web formation unit 45, the mixing unit 50, the second web formation unit 70, and the sheet formation unit 80 already shown in FIG. 1, but the description is omitted here.

The control unit 110 includes a CPU (not shown), a storage unit (ROM, RAM) (not shown), and a driver (not shown) and the humidity measurement unit 360 is connected thereto. A control signal is output to the driver, and a driving signal is transmitted from the driver to the first blower 320 and the second blower 340.

In the vaporization type humidification unit 300, based on the humidity measured by the humidity measurement unit 360, in a state where the air flow rate discharged from the second blower 340 is kept constant, an appropriate humidification amount is provided to the coarsely crushing unit 12, the first web formation unit 45, the rotating object 49, the second web formation unit 70, and the cutting unit 90 in a state where the air flow rate is kept constant by the variation of the air flow rate of the first blower 320.

Specifically, the control unit 110 outputs a control signal to the driver and controls the air flow rate of the first blower 320 and the second blower 340, in other words, the number of rotations of the motors built in the first blower 320 and the second blower 340.

When the number of rotations of the motor of the second blower 340 is fixed and the number of rotations of the motor of the first blower 320 is varied, a difference is generated between the air flow rate of the first blower 320 and the air flow rate of the second blower 340. This difference is resolved by the intake of the outside air through the opening 350 or discharging. In this way, it is possible to adjust the humidity while keeping the air flow rate of the discharge of the second blower 340 constant.

When the measured humidity of the humidity measurement unit 360 is high relative to the predetermined humidity, the air flow rate of the first blower 320 is reduced, and the second blower 340 takes in the outside air from the opening 350 to compensate for the air flow rate reduced by the first blower 320 and discharge the constant air flow rate. Also, when the measured humidity of the humidity measurement unit 360 is low relative to the predetermined humidity, the air flow rate of the first blower 320 is raised, the intake flow rate of the outside air from the opening 350 is reduced by as much as the air flow rate raised by the first blower 320, and the constant air flow rate is discharged from the second blower 340. When the air flow rate of the first blower 320 is larger than the air flow rate of the second blower 340, the excessive humidification air is discharged from the opening 350.

Also, as the air flow rate of the first blower 320 varies, the mixing ratio of the air flow rate discharged from the first blower 320 to the outside air varies. In this way, it is possible to control the humidification amount. Therefore, it is possible to control the humidification amount with the constant air flow rate.

<Control Method>

Figure 4:
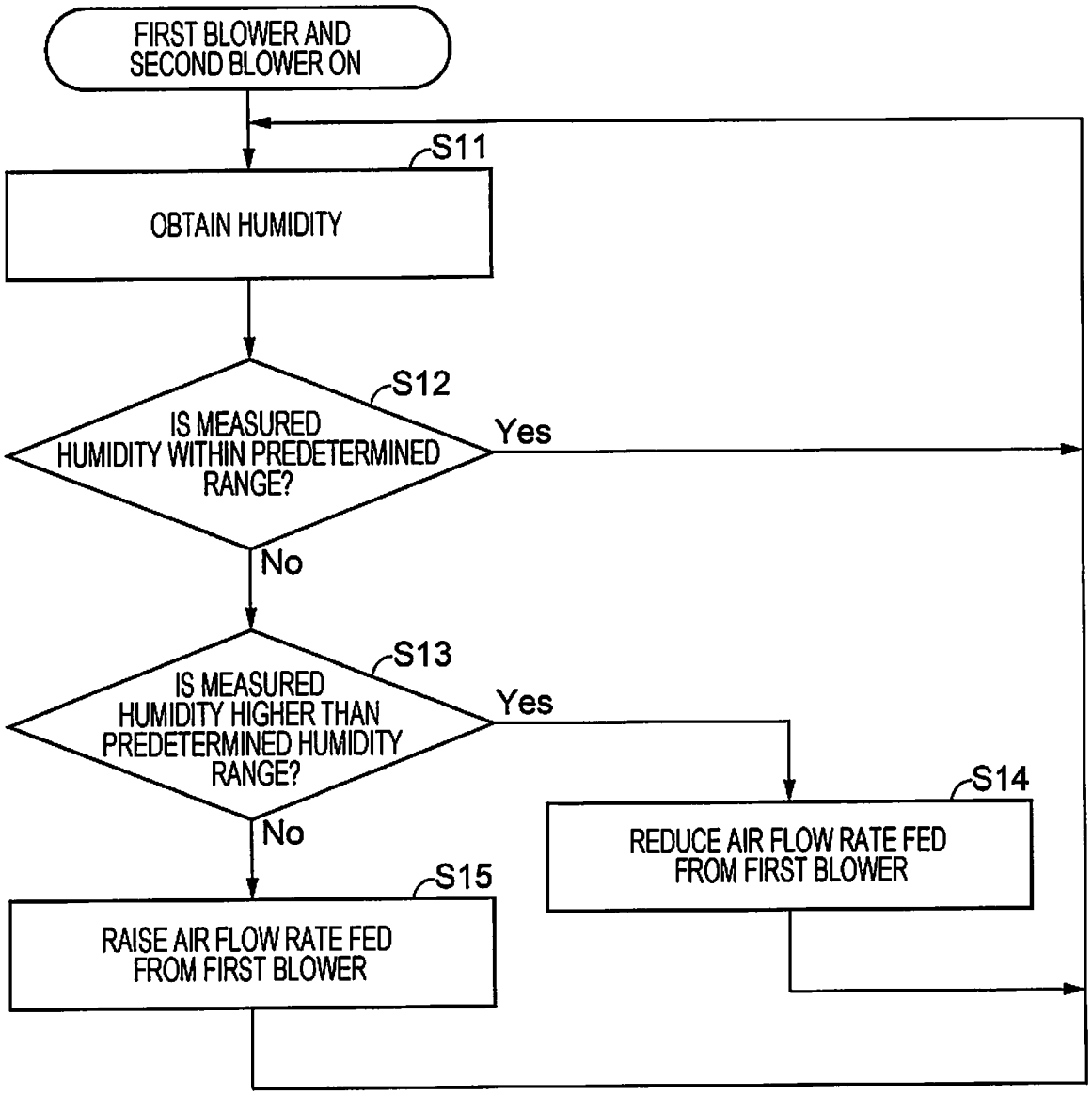
FIG. 4 is a flowchart showing a control method of the vaporization type humidification unit.

Next, the control method of the vaporization type humidification unit 300 will be described. FIG. 4 is a flowchart showing control method of the vaporization type humidification unit. In the control method of the vaporization type humidification unit 300, in a state where the air flow rate discharged from the second blower 340 is kept constant, the air flow rate discharged from the first blower 320 is controlled based on the humidity measured by the humidity measurement unit 360.

In the present embodiment, the case where the rotational driving of the second blower 340 is controlled to be constant (constant air flow rate) will be described.

In step S11, the humidity is obtained. Specifically, the control unit 110 calculated the humidity based on the measurement signal of the humidity measurement unit 360.

In step S12, the calculated humidity is compared with the predetermined humidity set in advance, and it is determined whether or not the calculated humidity is within the predetermined humidity range set in advance. Then, when the calculated humidity is within the predetermined humidity range, the determination is Yes and proceeding to step S11 is made.

When the humidity measured by the humidity measurement unit 360 is not within the predetermined humidity range, the determination is No and processing to step S13 is made.

In step S13, it is determined whether or not the calculated humidity is high relative to the predetermined humidity range. When the calculated humidity is high relative to the predetermined humidity range, the determination is Yes and proceeding to step S14 is made.

In step S14, the control unit 110 controls the driving rotation of the motor and reduces the air flow rate of the first blower 320. At this time, the outside air flow rate as much as the air flow rate reduced by the first blower 320 is taken in through the opening 350 and discharged from the second blower 340.

In this way, while the air flow rate of discharge of the second blower 340 is constant, the mixing ratio of the air flow rate discharged from the first blower 320 to the outside air flow rate introduced through the opening 350 varies, and the share of the outside air flow rate increases.

Therefore, it is possible to reduce the humidification amount and lower the humidity of the air discharged from the second blower 340.

On the other hand, when the humidity measured by the humidity measurement unit 360 is not high relative to the predetermined humidity range, that is, when the calculated humidity is low relative to the predetermined humidity range, the determination is No and proceeding to step S15 is made.

In step S15, the control unit 110 controls the driving rotation of the motor and raises the air flow rate of the first blower 320. At this time, the outside air flow rate taken in through the opening 350 declines by as much as the air flow rate raised by the first blower 320.

In this way, the mixing ratio of the air discharged from the first blower 320 to the outside air flow rate introduced through the opening 350 can vary while the air flow rate discharged from the second blower 340 is constant, and the share of the outside air flow rate declines.

Therefore, it is possible to raise the humidification amount and raise the humidity of the air discharged from the second blower 340.

As described above, according to the vaporization type humidification unit 300 and the control method of the vaporization type humidification unit 300 according to the present embodiment, it is possible to obtain the following effects.

(1) In the vaporization type humidification unit 300 and the control method of the vaporization type humidification unit 300, by keeping the air flow rate of the discharge from the second blower 340 constant and varying the air flow rate of the first blower 320, it is possible to vary the mixing ratio of the air discharged from the first blower 320 to the outside air flow rate introduced from the opening 350. In this way, it is possible to control the humidification amount. That is, in a state where the air flow rate discharged from the second blower 340 is kept constant, it is possible to control the humidification amount easily. Further, since it is possible to vary the humidification amount in a short time only by varying the air flow rate of the first blower 320, it is possible to control the humidification amount with good responsiveness.

(2) In the sheet manufacturing apparatus 100, when the coarsely crushing unit 12, the drum unit 41, the rotating object 49, the drum unit 61, and the cutting unit 90 are humidified by the vaporization type humidification unit 300, for example, it is possible to humidify appropriately while the air flow rate is kept constant, and it is possible to avoid stagnation of the raw material including fibers under the influence of electrostatic charge and adhesion of raw materials to each other and to adjust the moisture amount of the raw material without inflicting an adverse effect on the transport air or the sheet accumulation unit. In this way, it is possible to suppress non-uniformity in the sheet density.

It should be noted that the present invention is not limited to the embodiments described above, and it is possible to add various modifications, improvements, and the like to the embodiments described above. Modification examples will be described below.

Modification Example 1

Figure 5:
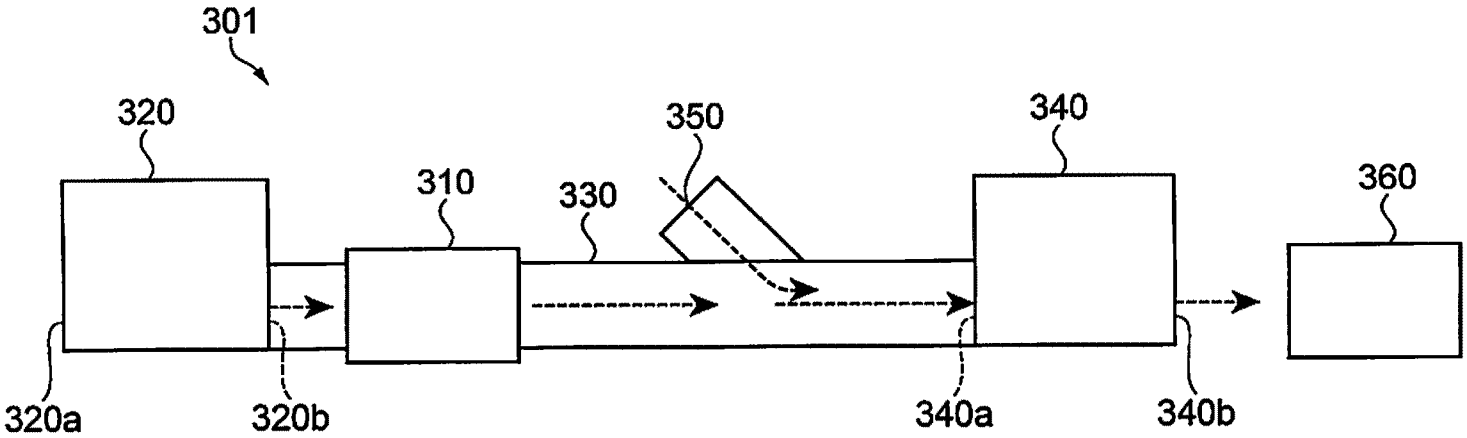
FIG. 5 is a schematic diagram showing a configuration of the vaporization type humidification unit according to Modification Example 1.

FIG. 5 is a schematic diagram showing a configuration of a vaporization type humidification unit 301 according to the modification example 1. In the embodiment described above, as shown in FIG. 2, the description was that the first blower 320 sucks the air that has passed through the vaporization unit 310, but this configuration is not limited thereto.

In the following, the vaporization type humidification unit 301 according to Modification Example 1 will be described. The components same as those of the embodiment will be denoted by the same reference numerals and the duplicate descriptions will be omitted.

As shown in FIG. 5, the vaporization type humidification unit 301 includes a vaporization unit 310 that evaporates moisture, a first blower 320 that discharges the air (sucked outside air) toward the vaporization unit 310, a transport tube 330 that is connected to the vaporization unit 310 and through which the air that has passed the vaporization unit 310 is transported, a second blower 340 connected to the transport tube 330 and discharging the air discharged from the vaporization unit 310 toward the outside, an opening 350 provided in a middle of the transport tube 330, a humidity measurement unit 360 installed on the discharging side of the second blower 340, and a control unit 110 that controls the air flow rate discharged from the first blower 320 and the second blower 340.

Based on the humidity measured by the humidity measurement unit 360, an appropriate humidification amount is provided in a state where the air flow rate is kept constant while the air flow rate of the first blower 320 is varied and the air flow rate discharged from the second blower 340 is controlled to be constant.

Therefore, it is possible to avoid the stagnation of the raw material including fibers under the influence of electrostatic charge and the adhesion of the raw materials with each other and to adjust the moisture amount of the raw materials to each other without inflicting an adverse effect on the transport air or the sheet accumulation unit, and it is possible to suppress the non-uniformity of the sheet density.

As described above, according to the vaporization type humidification unit 301 and the control method of the vaporization type humidification unit 301 according to the modification example, it is possible to obtain the same effect as described above.

Modification Example 2

The opening 350 is not limited to the idle of the transport tube 330, and the opening 350 may be provided in the vaporization unit 310. In this case, the opening 350 is installed on the side, past the humidification filter, of the transport tube 330 through which the humidification air is transported. In this way, the opening 350 is unnecessary in the transport tube 330 between the first blower 320 and the second blower 340, the structure of the vaporization type humidification unit 300 is simplified, and the degree of freedom of the shape of the transport tube 330 becomes high.

Modification Example 3

In the above embodiment, the description was that the number of rotations of the motor of the second blower 340 is controlled to be constant, but this configuration is not limited thereto. In the following, a vaporization type humidification unit 300 according to Modification Example 3 will be described.

When the transport tube 330 is sufficiently long, the influence of the variations of the air flow rate of the first blower 320 on the air flow rate of the second blower 340 is small. On the other hand, when the transport tube 330 is short, for example, the air flow rate of the second blower 340 is affected in some cases when the air flow rate of the first blower 320 varies. In such a case, a wind speed sensor is installed on the discharging side of the second blower 340, and, in accordance with the air flow rate of the first blower 320, the number of rotations of the motor of the second blower may be controlled based on the measured wind speed such that the air flow rate of the second blower 340 is constant.

As described above, according to the vaporization type humidification unit 300 according to Modification Example 3, the following effects can be obtained in addition to the effects of the embodiments.

In the vaporization type humidification unit 300 and the control method of the vaporization type humidification unit 300, if the air flow rate of the first blower 320 is varied in a state where the number of the rotations of the motor of the second blower 340 is constant, it is possible to keep the air flow rate constant even when the air flow rate discharged from the second blower varies. Therefore, it is possible to control the humidification amount easily in a state where the air flow rate discharged from the second blower 340 is kept constant.

A part of the configuration may be omitted from the present invention within a range of features and effects described in the present application. A part of the configuration may be omitted from, another configuration may be added to, or a publicly known technique may replace the sheet manufacturing apparatus 100 within a range where the sheet can be manufactured.

The present invention includes substantially the same configuration (for example, configuration of the same function, method, and result and configuration of the same object and effects) as the configuration described in the embodiments and the modification examples. Also, the present invention includes a configuration in which non-essential parts of the configuration described in the embodiments are replaced. Also, the present invention includes a configuration that achieves the same operational effect as the configuration described in the embodiments or a configuration that can achieve the same object. Also, the present invention includes a configuration obtained by adding a publicly known technique to the configuration described by the embodiments.

REFERENCE SIGNS LIST

2, 3, 7, 8, 23, 29, 54 tube
9 chute
10 supply unit
12 coarsely crushing unit
14 coarsely crushing blade
20 defibrillation unit
22 inlet port
24 discharge port
26 defibrillation unit blower
27 dust collecting unit
28 complementary collection blower
40 sorting unit
41 drum unit
42 inlet port
43 housing unit
44 discharge port
45 the first web formation unit
46 mesh belt
47 stretching roller
48 suction unit
49 rotating object
50 mixing unit
52 additive supply unit
52*a* discharge unit
56 mixing blower
60 accumulation unit
61 drum unit
62 inlet port
63 housing unit
70 the second web formation unit
72 mesh belt
74 roller
76 suction mechanism
77 suction blower
79 transport unit
79*a* mesh belt
79*b* roller
79*c* suction mechanism
80 sheet formation unit
82 pressing unit
84 heating unit
85 calendar roller
86 heating roller
90 cutting unit
92 the first cutting unit
94 the second cutting unit
96 discharge unit
100 sheet manufacturing apparatus
110 control unit
210, 212 humidification unit
300, 300*a*, 300*b*, 300*c*, 300*d*, 300*e*, 301 vaporization type humidification unit
310 vaporization unit
320 the first blower
330 transport tube
340 the second blower
350 opening
360 humidity measurement unit

The invention claimed is:

1. A vaporization type humidification unit comprising:
a vaporization unit that evaporates moisture;
a first blower that sucks a humidification air humidified by the vaporization unit;
a transport tube through which the air discharged from the first blower is transported, the transport tube including a first end that is directly connected to the first blower, and a second end that is opposite to the first end;
a second blower directly connected to the second end of the transport tube and discharging the humidification air discharged from the first blower side toward outside;
an opening provided in a middle of the transport tube;
a humidity measurement unit installed on a discharging side of the second blower; and
a control unit that controls an air flow rate discharged from the first blower and the second blower, wherein
the control unit controls the air flow rate discharged from the second blower to be kept constant at a desired value and controls the air flow rate discharged from the first blower to be varied based on a humidity measured by the humidity measurement unit.

2. The vaporization type humidification unit according to claim 1, wherein
the vaporization unit includes a humidification filter.

3. The vaporization type humidification unit according to claim 1, wherein when the measured humidity by the humidity measurement unit is high relative to a predetermined humidity, the control unit reduces the air flow rate of the first blower and keeps the air flow rate discharged from the second blower constant, such that an intake flow rate of outside air from the opening is raised.

4. The vaporization type humidification unit according to claim 1, wherein when the measured humidity by the humidity measurement unit is low relative to a predetermined humidity, the control unit raises the air flow rate of the first blower and keeps the air flow rate discharged from the second blower constant, such that an intake flow rate of outside air from the opening is reduced.

5. A control method of a vaporization type humidification unit that includes a vaporization unit that evaporates moisture, a first blower that sucks humidification air humidified by the vaporization unit, a transport tube through which the air discharged from the first blower is transported, the transport tube including a first end that is directly connected to the first blower, and a second end that is opposite to the first end, a second blower directly connected to the second end of the transport tube and discharging the humidification air discharged from the first blower side toward outside, an opening provided in a middle of the transport tube, and a humidity measurement unit installed on a discharging side of the second blower, the method comprising:

controlling an air flow rate discharged from the second blower to be kept constant at a desired value; and controlling the air flow rate discharged from the first blower to be varied based on a humidity measured by the humidity measurement unit.

6. A sheet manufacturing apparatus comprising:

the vaporization type humidification unit according to claim 1.

7. A sheet manufacturing apparatus comprising:

the vaporization type humidification unit according to claim 2.

8. A sheet manufacturing apparatus comprising:

the vaporization type humidification unit according to claim 3.

* * * * *